US012092408B2

(12) United States Patent
Drysdale et al.

(10) Patent No.: US 12,092,408 B2
(45) Date of Patent: Sep. 17, 2024

(54) COMBUSTION GUN

(71) Applicants: Neil Drysdale, London (GB); Miljan Dojin, Ruislip (GB)

(72) Inventors: Neil Drysdale, London (GB); Miljan Dojin, Ruislip (GB)

( * ) Notice: Subject to any disclaimer, the term of this patent is extended or adjusted under 35 U.S.C. 154(b) by 0 days.

(21) Appl. No.: 18/029,557

(22) PCT Filed: Oct. 18, 2021

(86) PCT No.: PCT/IB2021/059551
§ 371 (c)(1),
(2) Date: Mar. 30, 2023

(87) PCT Pub. No.: WO2022/090859
PCT Pub. Date: May 5, 2022

(65) Prior Publication Data

US 2023/0358489 A1 Nov. 9, 2023

(30) Foreign Application Priority Data

Oct. 26, 2020 (GB) ..... 2016992

(51) Int. Cl.
*F41A 1/04* (2006.01)

(52) U.S. Cl.
CPC ..... *F41A 1/04* (2013.01)

(58) Field of Classification Search
CPC ..... F41A 1/04; F41A 1/02
USPC ..... 89/1.1
See application file for complete search history.

(56) References Cited

U.S. PATENT DOCUMENTS 3,131,597 A * 5/1964 Smith ..... F41F 3/04 89/8
4,644,843 A * 2/1987 Soper ..... F41A 1/04 89/7
4,653,380 A * 3/1987 Griffing ..... F41A 1/04 102/440
4,729,319 A 3/1988 Orlando
4,949,621 A * 8/1990 Stephens ..... F41A 1/04 89/7
6,517,010 B1 * 2/2003 Barykin ..... C23C 4/126 239/428

(Continued)

FOREIGN PATENT DOCUMENTS

WO WO-2005119158 A1 * 12/2005 ..... F41A 1/04

OTHER PUBLICATIONS

International Search Report issued Dec. 22, 2021 in International Application No. PCT/IB2021/059551.

(Continued)

*Primary Examiner* — John Cooper
(74) *Attorney, Agent, or Firm* — Wood, Phillips, Katz, Clark & Mortimer

(57) ABSTRACT

A gun having at least two combustion chambers, a first combustion chamber being fixed within the gun, subsequent combustion chamber or chambers being movable in the direction of the barrel, wherein the trigger mechanism is adapted to ignite the volatile mixture in the first chamber; and the gun having means to regulate the timing of ignition of the volatile mixtures in the subsequent chamber or chambers to eject the bullet for the barrel. A reloading plate prevents a bullet being loaded, while the volatile mixtures are ignited.

9 Claims, 3 Drawing Sheets

(56) References Cited

U.S. PATENT DOCUMENTS

| | | | | |
|---|---|---|---|---|
| 7,665,396 | B1 * | 2/2010 | Tippmann, Jr. | B25C 1/08 89/7 |
| 8,826,792 | B1 * | 9/2014 | Granger | F41A 1/04 89/7 |
| 9,222,737 | B1 * | 12/2015 | Lund | F41A 1/04 |
| 2002/0100361 | A1 * | 8/2002 | Russell | F41B 11/00 89/14.5 |
| 2006/0166153 | A1 * | 7/2006 | Rusch | F23L 7/007 431/207 |
| 2006/0266206 | A1 * | 11/2006 | Lund | F41A 1/04 89/1.3 |
| 2007/0175324 | A1 * | 8/2007 | Adams | F41B 11/721 89/7 |
| 2020/0271406 | A1 * | 8/2020 | Luo | F41A 7/06 |

OTHER PUBLICATIONS

International Preliminary Report on Patentability, issued Feb. 16, 2023 in Int'l Appln. No. PCT/IB2021/059551.

Search Report issued Apr. 19, 2021, in Patent Application No. GB2016992.6.

* cited by examiner

COMBUSTION GUN

BACKGROUND OF THE INVENTION

Field of the Invention

This invention relates to a combustion gun and in particular a gun having a mechanism which uses a combustion chamber within the body of the gun.

Background Art

Most guns operate by means of an explosion within a bullet cartridge. A firing pin strikes a primer at one end of a cartridge, which ignites a propellant powder in the cartridge. The explosion expels the bullet down the barrel. Although this technique has been generally accepted for many years, it does have the disadvantage that the cartridge must be ejected after each firing. It also requires moving parts.

Guns having internal combustion chambers for ejecting a bullet are known. For example, U.S. Pat. No. 8,826,792 discloses a projectile propulsion apparatus comprising a combustion chamber means and valve means enabling cartridge-free projectile propulsion. It employs liquid and/or gaseous propellants which can be injected into the device and combusted to provide the necessary pressures for propelling a projectile.

WO 2005119158 discloses a pistol in which the barrel contains a combustion chamber with a plug that produces sparks. Pellets are propelled from the barrel by means of pressure created by inflammable gas and oxygen mixture, ignited by a spark.

However, in both those prior described devices, the ignition and expansion of the gas takes place in the barrel location adjacent the bullet. The problem with such a design is that the heat generated by the ignition of volatile gases, unlike the propellant powder of a conventional cartridge, is usually sufficient to create extreme temperatures. Applying that heat direct to the bullet risks deformation of the bullet, so that it could jam in the barrel or even explode.

There is a need for a gun mechanism to harness the expansion or explosion properties of the ignition of a volatile gas mixture more safely; and therefore be applicable to any form of gun, including firearms.

SUMMARY OF THE INVENTION

The present invention avoids the use of cartridges by providing a combustion chamber within the body of a gun. Compressed fuel and oxidant gas are introduced into the chamber to form a volatile mixture, which is ignited to eject the bullet from the barrel.

Accordingly, the present invention provides a gun comprising a barrel, at least two combustion chambers, a fuel storage tank, a gas compression means and a trigger mechanism, each combustion chamber having a fuel inlet, and an oxidant inlet, a first combustion chamber having an ignition means and being fixed within the gun, subsequent combustion chamber or chambers being movable in the direction of the barrel, wherein the gas compression means is adapted to provide compressed fuel and oxidant gas to form volatile mixtures in the combustion chambers, and the trigger mechanism is adapted to ignite said volatile mixture in the first chamber; the gun having means to regulate the timing of ignition of the volatile mixtures in the subsequent chamber or chambers to eject the bullet from the barrel.

The provision of multiple combustion chambers within the gun may allow harnessing the expansion or explosion properties of the ignition of a volatile gas mixture more safely.

In one form, the invention is directed to a gun having a barrel, at least two combustion chambers, a fuel storage tank, a gas compression means and a trigger mechanism. Each combustion chamber has a fuel inlet and an oxidant inlet. A first combustion chamber has an ignition means and is fixed within the gun, such that the ignition in the first chamber creates an expansion of gas, which is directed towards the second and further subsequent chamber or chambers to move them forward towards the bullet. The gas compression means is adapted to provide compressed fuel and oxidant gas to form volatile mixtures in the combustion chambers. The trigger mechanism is adapted to ignite said volatile mixture in the first chamber. The gun has a means to regulate the timing of ignition of the volatile mixtures in the subsequent chamber or chambers to eject the bullet from the barrel.

In one form, the fuel is hydrogen.

In one form, the oxidant is air.

In one form, the ignition means is a set of discharge terminals within the chamber.

In one form, the volume of fuel provided to the first chamber is greater than the volume of fuel provided to the subsequent combustion chambers.

In one form, the gun contains two combustion chambers.

In one form, the trigger is adapted to release fuel into chambers, prior to igniting the volatile mixture in the first chamber.

In one form, the gun further includes a reloading plate between the barrel and the magazine. The plate is movable between a first position in which bullets are prevented from entering the barrel, and a second position in which a bullet can be loaded into the barrel. When the plate is in the first position, the ignition circuits are operational. When the plate is in the second position, the ignition circuits are broken.

In one form, the plate is spring-loaded to remain in the first position to allow the gun to be fired.

BRIEF DESCRIPTION OF THE DRAWINGS

Specific embodiments of the present invention will now be described with reference to the accompanying drawings in which.

DETAILED DESCRIPTION OF THE PREFERRED EMBODIMENTS

Figure 1:
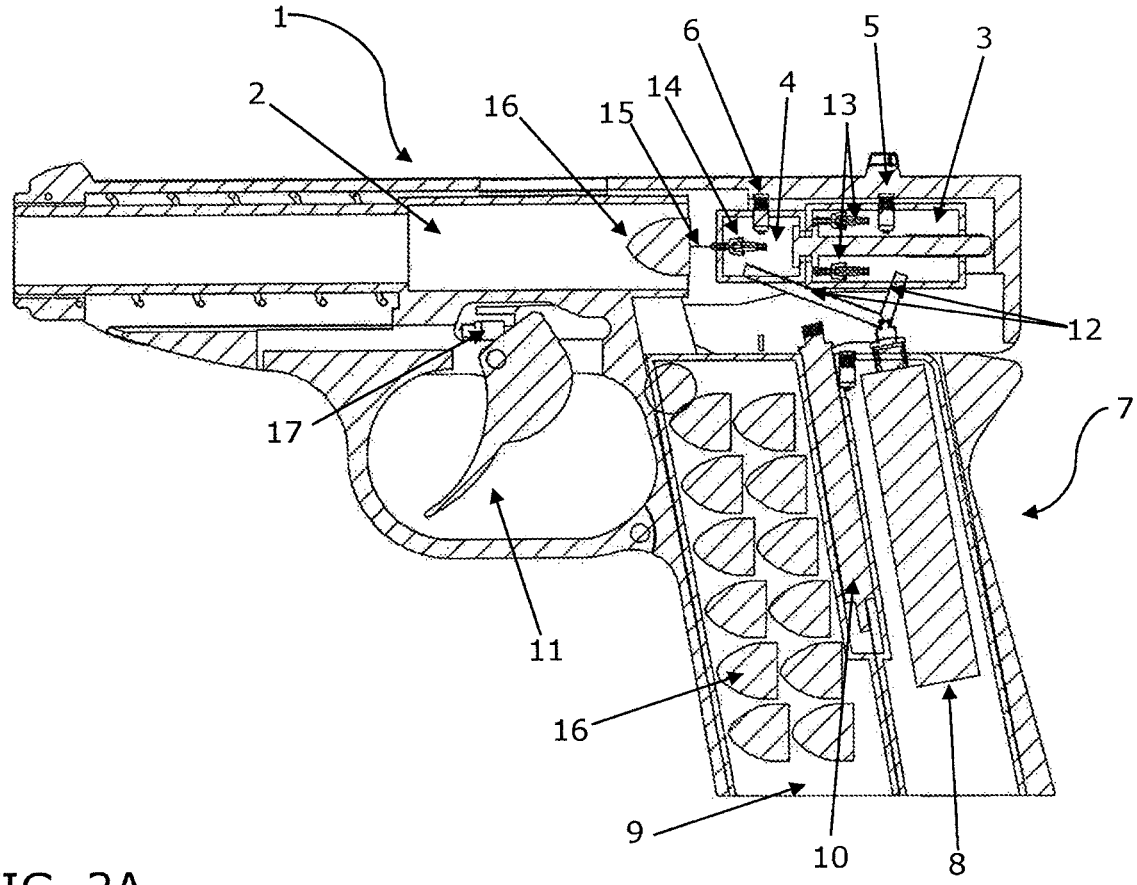
FIG. 1 is a cross sectional view of one embodiment of a gun of this invention.

Referring to FIG. 1, the body of a gun 1 contains a barrel 2, a first combustion chamber 3 and a second combustion chamber 4. The first chamber 3 has an air inlet 5; the second chamber has an air inlet 6. The first chamber 3 is fixed to the body of the gun; the second chamber 4 is movable towards the barrel 2. The handle 7 of the gun contains a fuel storage tank 8, a magazine 9, and a gas compression means in the form of a pump 10. The body of the gun also contains a trigger mechanism 11.

The fuel storage tank 8 contains hydrogen and is connected to the combustion chambers 3 and 4 via fuel inlets in the form of pipes 12.

The first combustion chamber 3 contains two one-way valves 13; the second combustion chamber 4 contains a one-way valve 14, which is slidable within the front wall of the second chamber 4 and carries a nipple 15.

Bullets 16 are contained in the magazine 9 and are fed into the barrel by a spring mechanism (not shown). When the magazine 9 is loaded into the handle of the gun, it operates the pump 10 which compresses the gas in each combustion chamber. Each chamber 3 and 4 then contains a compressed mixture of hydrogen and air.

In operation, the trigger of the gun is pressed and the upper part of the mechanism is pushed against an ignition source 17, creating an electric current in a circuit which terminates in two discharge terminals (not shown) located in the first combustion chamber 3. That creates a spark between the terminals which ignites the compressed hydrogen and air in the chamber, causing a rapid expansion of the gas mixture. The expanded gas passes through the one-way valves 13 and into the second combustion chamber 4, causing chamber 4 to move forwards rapidly in the direction of the barrel. The valve 14 is also pushed forwards, causing the nipple to strike the end of the bullet 16 and initiate the bullet's movement onto the barrel.

Almost immediately, the heat generated by the ignition in the first chamber 3 ignites the compressed mixture of gases in the second chamber 4, causing a further rapid expansion of gas directed at the bullet, which is thereby expelled from the gun.

Once the bullet is expelled, the spring in the magazine 9 causes another bullet 16 to be loaded into the barrel 2. The second chamber 4 recoils and returns to its original position adjacent the first chamber 3. The pressure in both chambers is released, creating a vacuum in the two chambers. The vacuum in the second chamber 4 causes the slidable valve 14 to be drawn back into that chamber; and the vacuum in both chambers draws further hydrogen and air into the combustion chambers. In this way, the gun is in a position for the next firing.

Figure 2A:
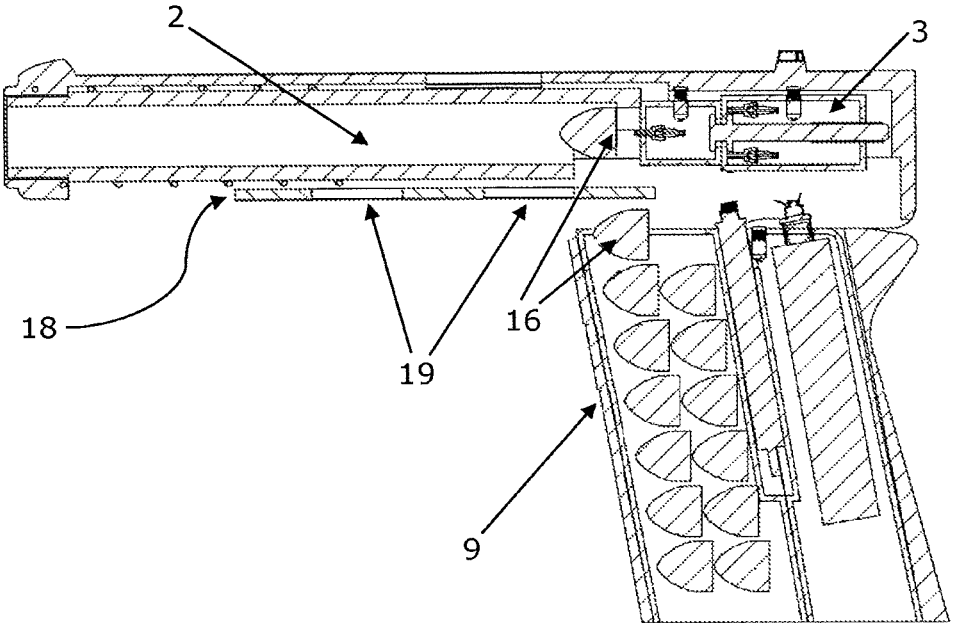
FIG. 2A shows a partial cross sectional view of the embodiment of FIG. 1, further containing a reloading plate in a first position.
Figure 2B:
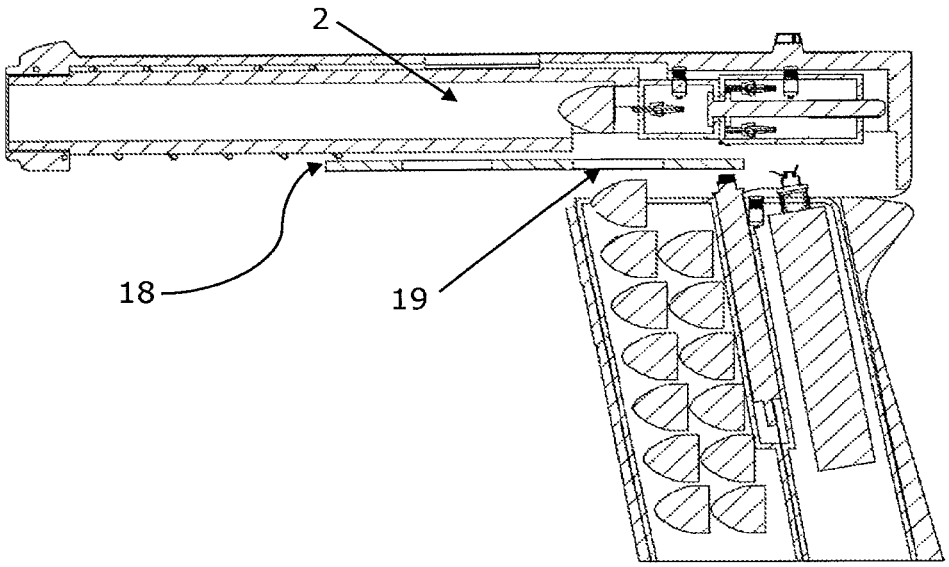
FIG. 2B shows a partial cross sectional view of the embodiment of FIG. 1, further containing a reloading plate in a second position.

FIGS. 2A and 2B depict a gun as shown in FIG. 1, with an additional feature of a reloading plate 18. Parts of the gun are omitted from FIGS. 2A and 2B, so that the feature 18 can be seen more clearly. The reloading plate 18 is situated in a horizontal position between the barrel 2 of the gun and the top of the magazine 9. The plate 18 is made of metal and has portions which have holes 19 through which a bullet can pass. One part of the ignition circuit is attached to the metal plate 18 and the second part of the ignition circuit can be brought into contact with the plate to complete the circuit, only when the plate is in certain positions.

In FIG. 2A, the plate 18 is in a position to prevent bullets 16 from passing from the magazine 9 into the barrel 2. This is the normal firing position for the gun and the plate 18 is held in this position by means of a spring (not shown). In this position, the ignition circuit is completed via the plate 18, so that the trigger mechanism can ignite the gas in the first chamber 3 of the gun.

In FIG. 2B, the plate 18 is in a position to allow bullets 16 to pass from the magazine 9 into the barrel 2. To reload the gun, the plate 18 is moved towards the rear of the gun into a position shown in FIG. 2B. This action moves the plate away from the second part of the ignition circuit, thus breaking the circuit and preventing ignition. It is now safe for a further bullet to be released from the magazine into the barrel 2, through the hole 19 in the plate 18. Once the bullet is loaded, the plate is released and is returned by the spring to the position shown in FIG. 2A, so that the gun is again operative.

Figure 3:
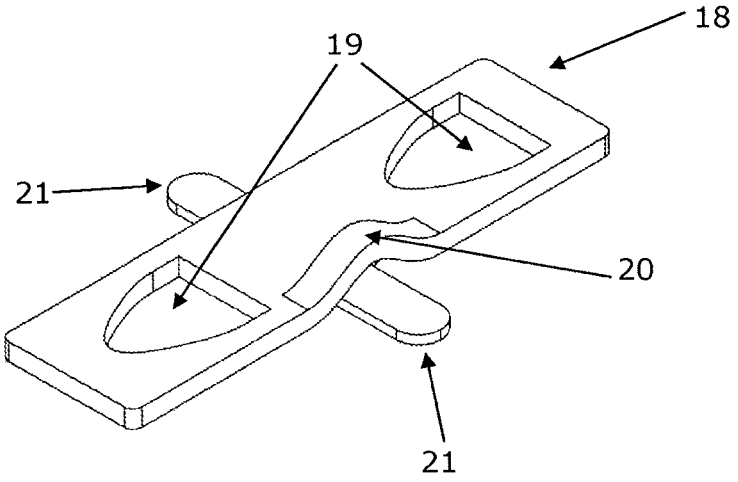
FIG. 3 is a perspective view of a reloading plate.

FIG. 3 shows the overall shape of the metal reloading plate 18, with holes 19 to accommodate the shape of a bullet. In the center of the plate, there is a raised metal bridge 20, which is brought into contact with the second part of the ignition circuit when the plate is moved. On each side of the plate 18 are situated protuberances 21, which form levers outside the body of the gun to allow manual operation of the reloading plate.

Figure 4:
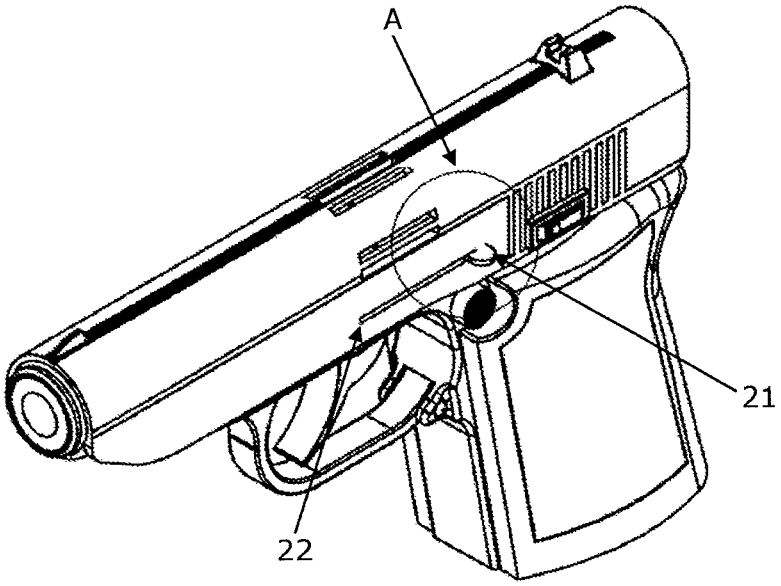
FIG. 4 is a perspective view of a gun of this invention, showing a slidable lever to move the reloading plate.

FIG. 4 depicts the lever mechanism on the outside of the gun, shown within the circle marked A. Thus, it can be seen that the levers 21 are moveable within a slot 22, situated along the side of the gun, to allow a user to slide the plate 18 to reload the gun.

The gun may be, for example, a handgun, rifle, shotgun, nail gun, or an artillery shell gun; it may be manual, single shot, semi-automatic, or fully automatic.

The gun of the present invention operates by using an expansion of gas in the combustion chambers to eject the bullet through the barrel, the expansion of gas being provided by the ignition of a volatile mixture of fuel and oxidant in the chambers. The fuel employed may be any gaseous or volatile material that is combustible with an oxidant. Suitable fuels include hydrogen, natural gas, and hydrocarbons, such as methane propane, butane, or petroleum. A preferred fuel is hydrogen, as it produces an extremely high expansion when ignited.

The fuel is stored in a fuel storage tank, which is suitably situated within the gun, for example within the handle of the gun. The fuel storage tank is connected via conduits, such as pipes, to provide a fuel inlet for each chamber. The flow of fuel into the chambers is controlled by a fuel valve. The fuel valve may be operated manually. Preferably, however, the fuel valve is operated by the trigger of the gun. For example, the trigger may be mechanically or electrically connected to the fuel valve, so that depressing the trigger first opens the fuel valve to allow a predetermined volume of fuel to enter the chambers; and further depression of the trigger ignites the volatile mixture in the first chamber.

The oxidant may be, for example, oxygen or air. In this case, the extremely high temperatures caused by the ignition process produce wet and dry superheated steam, which provides additional expansion of gases within the combustion chamber. Preferably, the oxidant is air, which may be conveniently drawn into the chambers from the atmosphere through oxidant inlets in the form of one-way valves. When the oxidant is other than air, a separate oxidant storage tank may be provided, with oxidant inlets to each chamber.

A gas compression means is provided to compress the gas within the chambers. Suitably the gas compression means comprises a pump, connected to each chamber. In one embodiment of this invention, a pump is situated within the handle of the gun, adjacent the magazine, such that loading the magazine causes the pump to be activated to compress the gas in each chamber. The gas compression means is required only when the magazine is loaded, prior to the gun being fired. It can therefore be considered as a primer. After the gun has been fired, the expansion of gas leaves a vacuum in each chamber, thus drawing further oxidant into the chambers; the recoil of the chambers then causes the oxidant in the chambers to be compressed, so that no further gas compression means is necessary.

At least the first chamber is provided with an ignition means, to ignite the volatile mixture therein. The ignition means is suitably a set of discharge terminals situated in the chamber, which create a spark therein. The electricity for the sparks is produced by an electricity generating ignition source, for example a piezoelectric generator. Alternatively, the ignition source could be a battery.

It is an important aspect of the present invention that the initial ignition of volatile gases is separated from the bullet. This is achieved by the provision of at least two combustion chambers. A first chamber is fixed within the gun. The subsequent chambers are movable and positioned between the first chamber and the barrel of the gun.

The trigger mechanism is adapted to ignite the volatile mixture in the first chamber, preferably by activating the ignition source. An electrical circuit between the ignition source and the ignition means, such as discharge terminals, then creates a spark in the first chamber. The effect of that ignition is to create an expansion of gas, which is directed towards the second and further subsequent chambers to move them forward towards the bullet. The means to direct the gas expansion from the first chamber towards the subsequent chambers may suitably be a series of one-way valves, such that the expanded gas in the first chamber is forced into the subsequent chambers. As the chambers are moved towards the barrel of the gun, construction of the chamber closest to the barrel initiates the movement of the bullet into the barrel. In one preferred mechanism, a one-way valve having a protuberance, such as a nipple, is slidable within the front wall of the chamber closest to the barrel. The expansion gas entering that chamber causes the said slidable valve to slide forward, so that the protuberance pushes the bullet into the barrel. The pressure of the gas in chamber causes the protuberance to be seated in the entrance of the barrel, creating a seal, thus preventing gas escaping into the body of the gun.

The initial momentum provided to the bullet is then supplemented by sequential ignitions in the subsequent combustion chambers. Those sequential ignitions produce additional expansion of gas in each chamber. The one-way valves allow gas to pass from the chambers onto the barrel, directed at the bullet, causing it to be expelled from the gun.

When all the gas has been discharged from the chamber closest to the barrel, the pressure is released, creating a vacuum within that chamber. That vacuum causes the slidable valve to be draw back into the chamber.

Thus, the bullet is not expelled from the gun by a single intense ignition adjacent the bullet. Instead, the bullet is expelled by means of a combination of multiple ignitions, in the form of an initial momentum from the first chamber and expansions of gas in the subsequent chambers. The further advantage of the multiple chambers is that the recoil of the gun is significantly less than with a single chamber.

The volume of fuel that is allowed to enter each chamber via the fuel inlet valves may be independently regulated. Preferably, the volume of fuel provided to the first chamber is greater than the volume of fuel provided to subsequent combustion chambers, so that the ignitions and gas expansions in the subsequent chambers are less powerful than the ignition and gas expansion in the first chamber. In this way, the initial momentum given to the bullet from the movement of the first chamber can be significant, without the heat generated in the first chamber being in contact with the bullet. For example, the volume of fuel in the subsequent chambers may be from 50% to 80% of the volume of fuel in the first chamber, suitably from 60% to 70%. A preferred ratio of fuel volumes in the first chamber to subsequent chambers is approximately 60%:40%.

The gun of this invention has means to regulate the timing of ignition of the volatile mixtures in the subsequent chamber or chambers. The means to regulate timing is conveniently provided by a control unit in each subsequent chamber, which control unit comprises a capacitor to store electricity from the ignition source, and a timing mechanism. Preferably, the control unit is in the form of a printed circuit board, or PCB.

In this case, each subsequent chamber also contains an ignition means, such as a set of discharge terminals. The ignition means in each chamber is activated in turn by the control unit.

An alternative means to regulate timing of the ignition in each chamber is provided by an electrical connector in each subsequent chamber, which connector is brought into contact with a connector situated on the interior wall of the gun, when the chamber is moved forward. The contact between the two electrical connectors completes an electrical circuit in that chamber with a capacitor in the control unit to initiate the ignition, for example by a spark from the discharge terminals within the chamber.

The timing of the ignition in the subsequent chambers depends on two variables: the initial position of the second and subsequent chambers with respect to the first chamber; and the position of the electrical connector in the second and subsequent chambers. Each of these variables may be predetermined in the manufacture of the gun, or may be adjustable in the gun, for example by means of threaded screws to vary the positioning. The size of the adjustment is approximately 0.1 mm or less.

A further, and preferred, means to regulate the timing of ignition in each chamber is provided by spring-loaded one-way valves between the chambers. Heat generated from the ignition in the first chamber is allowed to pass through the valve to ignite the volatile gas in each subsequent chamber. The timing of ignition in each subsequent chamber is regulated by adjusting the spring tension on each valve.

The variation in both the size of the gas expansion and the delay between ignitions enable the gun of this invention to accommodate the use of bullets of differing sizes and weights. A larger caliber bullet requires a larger gas expansion and a longer delay between the subsequent ignitions.

The number of chambers present in the gun of this invention is at least two and may be more, depending on the caliber and weight of the bullet or projectile and type of gun. For example, the gun may comprise from 2 to 5 chambers, suitably 2 to 4 chambers. For most smaller guns, preferably the gun contains two chambers.

The body of the gun of this invention should be constructed of materials sufficient to withstand high temperatures produced during combustion. Suitable materials include advanced plastic additives, steel and high strength aluminium, titanium, or other metal alloys.

In a further aspect of this invention, the gun contains a reloading plate between the barrel and the magazine, which plate is movable between a first position in which bullets are prevented from entering the barrel, and a second position in which a bullet can be loaded into the barrel; wherein when the plate is in the first position, the ignition circuits are operational, and when the plate is in the second position, the ignition circuits are broken. This is achieved by situating one connector of the ignition circuit on the reloading plate, so that the circuit can only be completed when the plate is in the appropriate position.

Suitably, the plate contains at least one lateral protuberance, which forms a lever outside the body of the gun to allow a user to move the plate forwards and backwards, parallel to the barrel of the gun.

In this way, during normal operation and firing of the gun, no further bullet can be loaded into the barrel. Preferably, the plate is spring-loaded to remain in the first position to allow the gun to be fired. When it is desired to reload the gun, the reloading plate is moved to the second position, which prevents ignition from occurring and allows a bullet to be loaded. Suitably the plate is moved rearwards in the gun to achieve the second position.

Preferably, when the reloading plate is in the second position, the fuel valve is also closed, so that no fuel can enter the chambers. This is achieved by the plate being constructed to lift the fuel valve release, providing a further safety feature during reloading.

In a further feature, the reloading plate can be moved to a third position, in which the bullets can be moved into the barrel and the fuel valve and ignition circuit are operational. This position of the plate is suitable for semi-automatic operation of the gun. Thus, when the trigger is depressed, it first opens the fuel valve to release fuel into the chambers. Further depression of the trigger then completes the ignition circuit, so that the gun is fired. As soon as the bullet is ejected, a further bullet moves from the magazine into the barrel and the firing process can be repeated immediately. Suitably the plate is moved forwardly in the gun to achieve the third position.

It is also possible to construct a fourth position for the reloading plate, which is suitable for fully automatic operation of the gun; and may be achieved, for example, by moving the plate further forward, beyond the third position. In this fourth position, bullets can be continually moved from the magazine into the barrel. In addition, the original ignition circuit and fuel valve are rendered inoperative, but a second ignition circuit and fuel valve are connected. This second fuel valve allows continual flow of fuel. The second ignition circuit is electronically programmable to control the ignition in the chambers. In this fourth position, the trigger is not required to control release of fuel, nor to complete the ignition circuit. Instead, the trigger may be adapted to be depressed to a third position which connects the programmed circuit to control the ignitions and thus operate the gun in automatic mode.

The foregoing disclosure of specific embodiments is intended to be illustrative of the broad concepts comprehended by the invention.

The invention claimed is:

1. A gun comprising a barrel, a plurality of combustion chambers including at least first and second combustion chambers, a fuel storage tank, a gas compressor, and a trigger mechanism, each of the combustion chambers in the plurality of combustion chambers having a fuel inlet, and an oxidant inlet, the first combustion chamber having an ignition source and being fixed within the gun, such that ignition in the first combustion chamber creates an expansion of gas, which expansion of gas is directed from the first combustion chamber towards the second combustion chamber and any subsequent combustion chamber or subsequent combustion chambers in the plurality of combustion chambers in addition to the first and second combustion chambers to move the second combustion chamber and the any subsequent combustion chamber or subsequent combustion chambers forward towards a bullet in the gun, wherein the gas compressor is adapted to provide compressed fuel and oxidant gas to form volatile mixtures in the plurality of combustion chambers, and the trigger mechanism is adapted to ignite said volatile mixture in the first combustion chamber, the gun having a regulator for the timing of ignition of the volatile mixtures in the any subsequent combustion chamber or subsequent combustion chambers to eject the bullet from the barrel.

2. A gun as claimed in claim 1, wherein the fuel is hydrogen.

3. A gun as claimed in claim 1, wherein the oxidant is air.

4. A gun as claimed in claim 1, wherein the ignition source comprises a set of discharge terminals within the first combustion chamber.

5. A gun as claimed in claim 1, wherein a volume of fuel provided to the first combustion chamber is greater than a volume of fuel provided to the any subsequent combustion chamber or subsequent combustion chambers.

6. A gun as claimed in claim 1, wherein the plurality of combustion chambers is only the first and second combustion chambers.

7. A gun as claimed in claim 1, wherein the trigger is adapted to release fuel into the plurality of combustion chambers, prior to igniting the volatile mixture in the first combustion chamber.

8. A gun as claimed in claim 1, which further contains a reloading plate between the barrel and a magazine, which plate is movable between a first position in which bullets are prevented from entering the barrel, and a second position in which a bullet can be loaded into the barrel, wherein when the plate is in the first position, ignition circuits on the ignition source are operational, and when the plate is in the second position, ignition circuits on the ignition source are broken.

9. A gun as claimed in claim 8, wherein the plate is spring-loaded to remain in the first position to allow the gun to be fired.

* * * * *